United States Patent [19]

Pandak

[11] 4,234,087

[45] Nov. 18, 1980

[54] COMBINATION TOOTHBRUSH CARRIER AND HOLDER

[76] Inventor: Zoltan I. Pandak, 53054 Dryden, Utica, Mich. 48087

[21] Appl. No.: 15,715

[22] Filed: Feb. 27, 1979

[51] Int. Cl.[3] ..... B65D 85/00

[52] U.S. Cl. ..... 206/362.2; 220/23.4; 220/213

[58] Field of Search ..... 206/361, 229, 45.31, 206/362.2; 248/110, 111; 211/65; 150/1.5 R, 52 G; 403/349, 109; 220/23.4, 213; 312/206, 307, 305, 326, 329, 349, 350

[56] References Cited

U.S. PATENT DOCUMENTS

| | | | |
|---|---|---|---|
| 486,828 | 11/1892 | Grauleff | 312/307 |
| 1,563,816 | 12/1925 | Worthington | 150/1.5 R |
| 1,952,686 | 3/1934 | Sakier | 312/206 |
| 2,051,847 | 8/1936 | Halstead | 312/206 |
| 2,520,819 | 8/1950 | Vratacoe | 312/307 |
| 2,694,495 | 11/1954 | Fawes | 312/305 |
| 2,725,270 | 11/1955 | Upchurch | 206/362.2 |
| 2,815,057 | 3/1955 | Tupper | 206/362.2 |
| 3,141,712 | 7/1964 | Holmes | 312/305 |
| 3,985,229 | 10/1976 | Maki | 150/1.5 R |
| 4,133,445 | 1/1979 | Mandebaum | 220/23.4 |

FOREIGN PATENT DOCUMENTS

| | | | |
|---|---|---|---|
| 24713 | 8/1906 | United Kingdom | 403/349 |

*Primary Examiner*—Herbert F. Ross
*Attorney, Agent, or Firm*—Remy J. VanOphem

[57] ABSTRACT

A combination toothbrush holder and carrier encloses a toothbrush for travel or storage and stands the brush upright for drying or display. The toothbrush is freely supported against the wall of a tube which forms the holder thereby eliminating the need for any special gripper or support element. Any of various means are provided to expose the brush to the air. These include open ends, a door sliding along the wall of the tube, or other similar openings. In all cases, the center of gravity and base of the holder are such that a supported brush is held substantially upright without upsetting the holder and brush.

11 claims, 7 Drawing Figures

COMBINATION TOOTHBRUSH CARRIER AND HOLDER

BACKGROUND OF THE INVENTION

I. Field of the Invention

This invention relates to toothbrush carrying cases, toothbrush holders, and particularly to the combination of such devices whereby the combination can both enclose a brush and hold a brush upright without overturning the device.

II. Description of the Prior Art

Many cases made of plastic, aluminum, and other materials have been produced for carrying toothbrushes when traveling. Other devices have been proposed to hold items upright for drying. None of these aforementioned devices to date, however, have combined the advantages of such devices to avoid the problems associated with either type of device singularly.

The carrying cases are adequate to enclose a toothbrush when traveling. Once the brush has been used, however, enclosing it again without drying can lead to the growth of bacteria, mold, or mildew. This is, naturally, to be avoided and can be avoided by drying the brush thoroughly before reinserting it into the carrier. Shaking the brush does not ordinarily dry it sufficiently. Since one does not always have a toothbrush rack available on the wall when traveling, the brush is often laid down, horizontally, on the counter or other surface to dry it. Unfortunately, this exposes both the handle and bristles to contamination or infestation from bacteria or other germs which are on the horizontal surface. Thus, although both the brush and carrier were originally clean, both are contaminated after one use of the brush. The user is forced to choose between two alternatives, equally unclean and unsatisfactory for dental hygiene.

Many devices have been proposed to assist one using a toothbrush; none, however, overcome the above-discussed problem entirely without unnecessary expense.

Magee, in U.S. Pat. No. 1,619,946, discloses a toothbrush and container designed for protecting the toothbrush from external contact before sale to the public. Magee provides a clear, thin plastic cover over the bristles such that the brush is not only protected but is also visible to the prospective purchaser's view. Magee does not provide a stand to hold the brush upright.

Thompson, in U.S. Pat. No. 2,177,504, discloses a case with a suction cup attached thereto for affixing the carrier to the wall or a horizontal surface. Thompson also provides a biased or resilient gripping member with jaws 32 and 34 as shown in FIG. 4. The brush must be forced between the jaws. This device is somewhat complicated and more expensive to manufacture than a simple carrier. Also, the biased gripping member with vertical slot 26 and longitudinal slot 16 seals rubber against an area of the brush handle. This seal can allow bacteria to grow. Of course, the suction cup can only be secured to a smooth surface or the cup will release dropping the holder and toothbrush.

Waters, in U.S. Pat. No. 2,576,551, discloses a dentifrice pack which holds a folding toothbrush. The dentifrice pack is designed to dispense toothpaste from a portion of the pack. The device holds a normal size toothbrush in an alternative embodiment. Waters does not disclose any means for supporting the toothbrush but provides ventilation holes in the casing to allow the brush to dry within the dispensing device.

Mechaneck, in U.S. Pat. No. 3,088,645, discloses a toothbrush cup which functions both as a cover for toothbrushes in a bathroom support rack and as a liquid retaining cup when slots on the side of the cup are in a nonregister position. The cup is inverted over the toothbrush rack and the slots are moved to a register position thereby allowing aeration and drying of toothbrushes. This device is usable only with a fixed support rack for toothbrushes and, therefore, is not truly portable.

Therefore, none of the devices shown in the prior art have provided a means for freely standing the toothbrush upright in a combination carrier and holder. Furthermore, none of the devices shown are of simple construction and accomplish the desired result of avoiding bacteria in the toothbrush and in the toothbrush carrier.

SUMMARY OF THE INVENTION

The purpose of the present invention is to provide a combination toothbrush carrier case and a stand which will freely hold a toothbrush in an upright position to allow the toothbrush to dry or to be retained in the open air, thereby avoiding bacteria from contact with other surfaces.

The combination toothbrush carrier and stand of the present invention has means for permitting access to the interior of the housing of the toothbrush carrier and also has means attached to that housing such that the toothbrush and carrier can be placed in an upright position, whereby the toothbrush is freely supported in an upright position for drying or storage. Of course, when the toothbrush is to be transported, such as when travelling, the housing of the carrier encloses the toothbrush to protect it from contact with other items.

Upright position, as used herein, means a position where a toothbrush is held in a substantially vertical position above a substantially horizontal surface; upright position also means a position where the combination toothbrush carrier and holder, or a part thereof, is in a substantially vertical position for holding a toothbrush upright by allowing the toothbrush to rest freely within the combination carrier and holder, or a part thereof. The usual situation for such upright position is where the brush is disposed in a tubular portion of the combination carrier and holder such that the handle end of the toothbrush is supported inside the tubular portion on a closed end of the tube, and the brush is also leaning against the side of the tubular portion.

It is, therefore, an object of the present invention to provide a combination holder and carrier for a toothbrush, which holder/carrier is truly portable for use in travel or for storing a toothbrush.

It is also an object of the present invention to provide a combination toothbrush carrier and holder which holds the toothbrush in a substantially vertical position to dry in the air.

It is also an object of the present invention to provide a toothbrush carrier and holder combination which holds a toothbrush in a vertical position on any substantially horizontal surface, regardless of the texture of the surface.

It is also an object of the present invention to provide a combination toothbrush carrier and holder which gives easy access to the toothbrush carried or held therein.

It is also an object of the present invention to provide an inexpensive, durable, combination toothbrush carrier and holder which is of uncomplicated construction and is also simple to use.

It is also an object of the present invention to provide a combination toothbrush carrier and holder which needs no extra mechanisms or special materials, such as rubber, to hold a toothbrush in an upright position.

It is also an object of the present invention to provide a combination toothbrush carrier and holder which functions as a holder by supporting a toothbrush in a substantially vertical position above a substantially horizontal surface, thereby avoiding the growth of bacteria, mold, or mildew on the brush.

It is also an object of the present invention to provide a combination toothbrush carrier and holder which avoids the transfer of bacteria, mold, or mildew from a brush to the toothbrush carrier/holder.

It is also an object of the present invention to provide a toothbrush carrier and holder combination which does not require special gripping or biased means whereby a brush is resiliently held in an upright position to avoid the growth of bacteria, mold, or mildew.

The many objects, advantages, and applications of the present invention will become apparent to those skilled in the art when the following description of some examples of the best mode contemplated for practicing the invention is read in conjunction with the accompanying drawings, wherein;

DESCRIPTION OF THE PREFERRED EMBODIMENT

Figure 1:
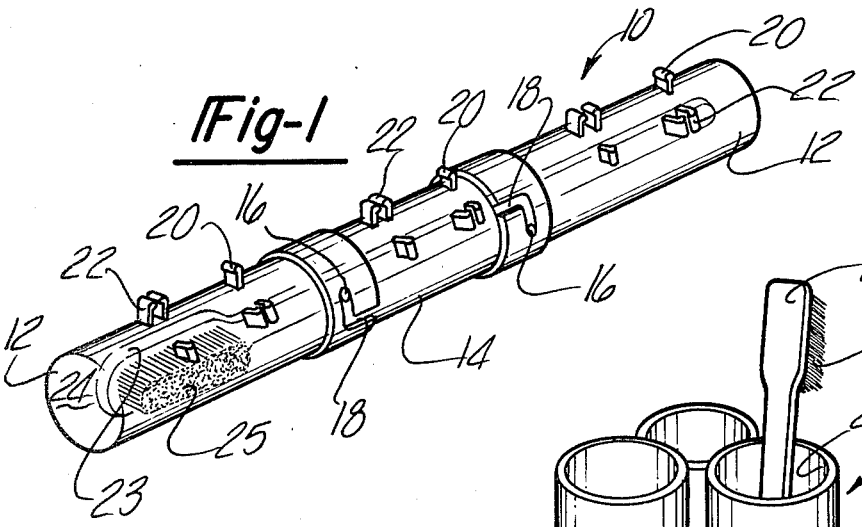
FIG. 1 is a side elevational view of a first embodiment of the combination toothbrush carrier and holder with the combination shown in the carrier configuration.

With reference to FIG. 1, the combination toothbrush carrier and holder 10 of the present invention is there shown and includes two end cylindrical portions 12 and a center cylindrical portion 14. The end portions 12 are closed at one end and the center portion 14 is open at both ends. The three cylindrical portions fit together with a raised bead 16 inserted into an L-shaped opening 18 so as to lock the adjacent pieces together. Each section also has attached thereto both a male snap lock projection 20 and a female snap lock pair of projections 22. Each of the cylindrical portions also contains another pair of snap lock projections 20 and 22 shown in FIGS. 1 and 2.

The cylindrical portions are conveniently made of a molded plastic or other suitable material which is both durable and protects a toothbrush 23 enclosed within the housing of the device 10.

Figure 2:
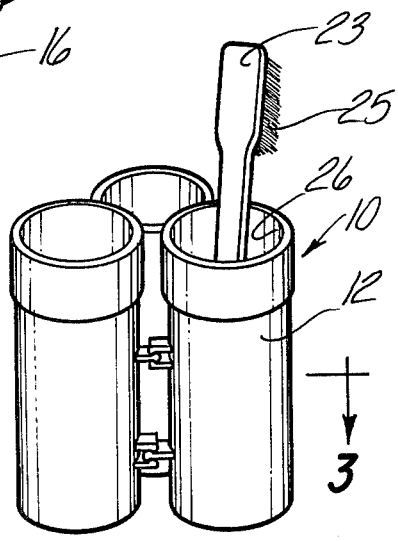
FIG. 2 is a perspective view of a first embodiment of the invention which shows the combination toothbrush carrier and holder in the upright position for holding the toothbrush vertically, showing the sections of the housing snapped together with the brush contained in one of the end sections of the housing.

FIG. 2 shows the combination toothbrush carrier and holder 10 in the reconfigured position with a triangular base and the toothbrush 23 supported therein. The toothbrush 23 is freely disposed within one of the tubular sections 12 having a closed end 24. No special mechanism is required in the bottom of the portion 12 where the end of the toothbrush is supported. Since the portions snap together to form a triangular base, the center of gravity of the carrier/holder is lowered substantially to thereby freely support the toothbrush within the portion 12. The brush leans against the side wall 26 of the portion 12 and no additional mechanism is required to support the toothbrush.

With the toothbrush 23 inserted in one of the portions of the combination carrier/holder 10, the bristles 25 of the brush are in a position above the holder portions and are thereby exposed to the air to allow drying of the brush. Furthermore, no portion of the bristles or handle are touching or sealed against a resilient or flexible portion such that an area is created whereby bacteria might grow.

Figure 3:
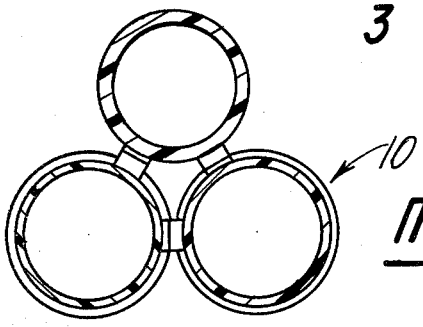
FIG. 3 is a cross-sectional view of FIG. 2 looking down on the combination in the holder configuration.

FIG. 3 is a cross-sectional view of FIG. 2 looking down on the reconfigured toothbrush holder 10. The snap lock projections 20, 22 are schematically shown as joined between the tubular portions 12 and 14.

Figure 4:
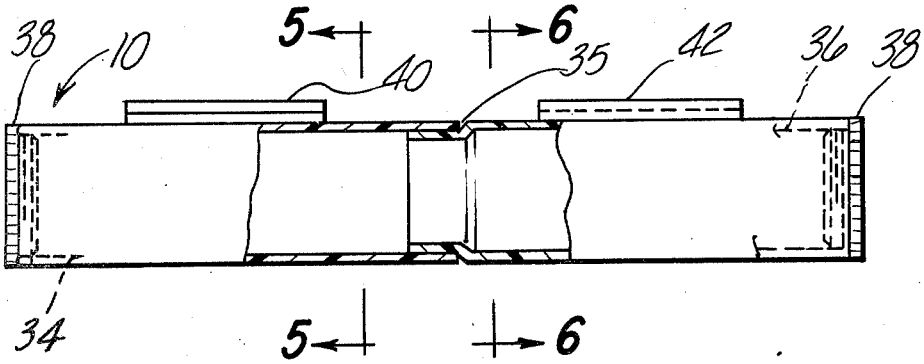
FIG. 4 is a side view, partially exposed, of an alternative embodiment of the invention having two interference-fitting tubular sections, screw-on end caps, vent holes, and gibs to position the holder in the upright position.
Figure 5:
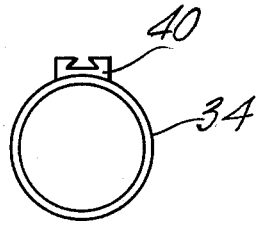
FIG. 5 is an end view of one tubular section of the embodiment shown in FIG. 4, showing the female gib.
Figure 6:
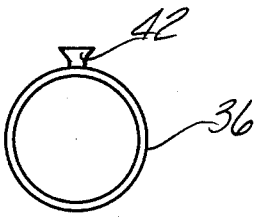
FIG. 6 is an end view of the othe tubular section of the embodiment shown in FIG. 4, showing the male gib.

FIGS. 4–7 show an additional embodiment of the invention where the combination carrier/holder has a housing which is made of two tubular portions. The two tubular portions 34 and 36 may fit together by any of many convenient known means for adjoining such tubular sections. These include screw or interference fit joints. FIG. 4 shows an interference fit joint at 35. Each of the tubular portions 34 and 36 of the device 10 may additionally have screw or interference fit end caps 38 as shown in FIG. 4.

Figure 7:
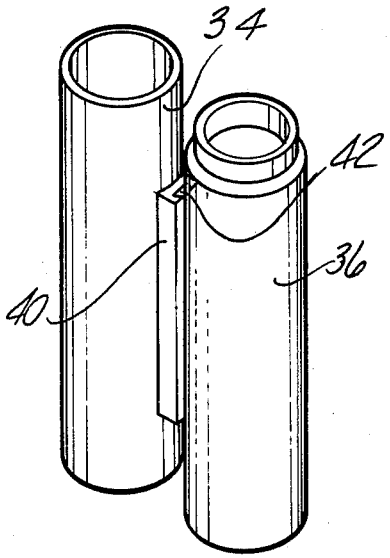
FIG. 7 is a side elevational view of another embodiment of the invention showing the combination toothbrush carrier and holder with two tube sections joined by an interference fit and having both vent holes and rib connecting elements.

One tubular portion 34 has a female gib 40 thereon for receiving the male rib-like gib 42 disposed on the other tubular portion 36. The male gib 42 is inserted down into the female portion 40 of the gib to position the two tubular portions adjacent to each other for a stabilizing holding base as shown in FIG. 7. Of course, it should be realized that any of the embodiments shown may use two or more tubular portions to reconfigure into a holder stabilizing base. It should also be realized that any other means of attachment fastening known in the art is suitable for attachment of the tubular portions to each other. Velcro strips are a good example. Velcro is a trademark of the Velcro Corporation. It should also be noted that in any case, the attachment fasteners or other means of attaching one tubular portion to another should be appropriately formed and positioned on the tubular portions such that the portions may be fitted side by side to form a stabilizing base for insertion of a toothbrush to hold the toothbrush in an upright position.

Having described by invention, it will be apparent to those skilled in the art to vary certain aspects of the invention without departing from the scope or spirit thereof. Although the invention has been shown in one, two, and three section configurations, the number, location, and method of reconfiguring the elements may vary. Functionally equivalent components may be substituted for the fastening means, tubular portion joining means, or other elements of the invention without deviating from the invention. Although the invention has been described with reference to a particular arrangement in the preferred embodiment shown, changes may be made in the precise details shown and other forms may be adopted as may come within the scope of the claims which follow. Also, certain features of the invention may be used to advantage without corresponding use of other features.

It should be noted that the carrier/holder of the present invention is also usable with thermometers, artist's brushes, and other articles in addition to brushes of various sizes.

In summary, it is intended that the illustrative and descriptive materials herein are used only to illustrate the principles of the invention and not to limit the scope of the invention as defined in the appended claims.

What I claim is:

1. A combination toothbrush container and stand comprising:

an elongated housing comprising:

a first cylindrical tubular portion having a reduced outer diameter portion at one end; a first internal diameter portion at the opposite end; a central outer diameter and a central portion therebetween with a central cylindrical passage therethrough;

a second cylindrical tubular portion having one end with an internal diameter portion adapted to receive the reduced outer diameter portion of said one end of the first cylindrical tubular portion; an opposite end with a second internal diameter portion; a central outer diameter portion therebetween; and a central cylindrical passage therethrough such that said first and second cylindrical tubular portions are joined together by mounting said reduced outer diameter portion of said first cylindrical member into said internal diameter portion on said one end of the second cylindrical tubular portion to form said housing;

a first cap member mounted into said first internal diameter portion at said opposite end of the first cylindrical tubular portion such that said first cap member closes said opposite end of the central cylindrical passage of the first cylindrical tubular portion;

a second cap member mounted into said second internal diameter portion at said opposite end of the second cylindrical tubular portion such that said second cap member closes said opposite end of the central cylindrical passage of the second cylindrical tubular portion and thereby provide a closed container for housing a toothbrush;

a first coupling member mounted to the central outer diameter portion of one of said cylindrical tubular portions; and a second coupling member mounted to the central outer diameter portion of the other of said cylindrical tubular portions such that when it is desirous to utilize the toothbrush within said container said first and second cylindrical tubular portions of the housing are separated at said one end and said first coupling member is joined to said second coupling member, with said one end of each of said first and second cylindrical tubular portions oriented in an upright direction, thereby providing an upright stand to support the toothbrush to permit drying of the toothbrush in a free air stream after use.

2. The toothbrush container and stand as claimed in claim 1 wherein said reduced outer diameter portion at said one end of the first cylindrical tubular portion further comprises a screw threaded portion and wherein further said internal diameter portion of said one end of the second cylindrical tubular portion further comprises a screw threaded portion communicating with the screw threaded portion on the one end of the first cylindrical tubular portion thereby providing for the first and second cylindrical tubular portion to be threadably mounted together to form a housing.

3. The toothbrush container and carrier as claimed in claim 2 wherein said first and second internal diameter at said opposite end portions of the first and second cylindrical tubular portions further comprises a screw threaded portion; and wherein further said first and second cap member each further comprise a screw threaded portion, said screw threaded portion of each of said first and second cap members communicating respectively with said screw threaded portion on the first and second diameter at the opposite end of said first and second cvlindrical tubular portion to thereby provide for the first cap member to be threadably mounted into the first cylindrical portion of the housing and further provide for the second cap member to be threadably mounted to the second cylindrical portion of the housing.

4. A combination toothbrush container and stand comprising:

an elongated housing comprising:

a cylindrical tubular portion having one end, an opposite end, and a central passage therethrough;

at least two coupling members mounted to the outer diameter of said cylindrical tubular portion;

at least two cylindrical tubular end portions mounted contiguous said cylindrical tubular portion, each of said at least two cylindrical tubular end portions having an open end mounted to said cylindrical tubular portion, a closed end opposite said open end; and an internal diameter between said open end and said closed end;

means for mounting said open end of each of said at least two cylindrical tubular end portions to said cylindrical tubular portion, said mounting means being contiguous with said open end of each of said at least two cylindrical tubular end portions, such that, when said at least two cylindrical tubular end portions and said cylindrical tubular portion are used as a toothbrush holder, said open end of one of said at least two cylindrical tubular end portions is mounted to said one end of the cylindrical tubular portion and said open end of said other of said at least two cylindrical end portions is mounted to said opposite end of said cylindrical tubular portion to form an enclosed toothbrush container; and means for simultaneously engaging said at least two cylindrical tubular end portions with said cylindrical tubular portion such that when said housing is used as a stand, said at least two cylindrical tubular end portions are attached with said open end of each of said end portion oriented in an upright direction to said cylindrical tubular portion by said simultaneous engaging means, to form a stand for supporting said brush while said toothbrush is in use and to permit drying of the toothbrush in a free air stream after use.

5. The toothbrush container and carrier as claimed in claim 4 wherein said mounting means comprises an inside diameter on said open end on each of said at least two cylindrical tubular end portions; and an outside diameter on said one end and said opposite end on said cylindrical tubular section which is slightly larger than said inside diameter on each of said at least two cylindrical tubular end portions such that when said inside diameter of said at least two cylindrical portions is engaged to said outside diameter on one end of said cylindrical tubular portion and said inside diameter of said other of said at least two cylindrical end portions is engaged to said outside diameter on said opposite end of said cylindrical tubular portion, an enclosed toothbrush container is formed.

6. The toothbrush container and carrier as claimed in claim 4 wherein said mounting means comprises:

a screw thread on said open end on each of said at least two cylindrical tubular end portions; and a mating screw thread on said one end and said opposite end of said cylindrical tubular portion such that when said screw thread of said at least two cylindrical portions is engaged to said mating screw thread on said one end of said cylindrical tubular portion and said screw thread of said other of said at least two cylindrical end portions is engaged to said opposite end of said cylindrical tubular portion, an enclosed toothbrush container is formed.

7. The toothbrush container and carrier as claimed in claim 4 wherein said mounting means comprises:

an "L" shaped slot on said open end on each of said at least two cylindrical tubular end portions; and a bead on said one end and said opposite end on said cylindrical tubular portions such that when said "L" shaped slot on said open end on each of said at least two cylindrical tubular end portions is engaged with to said bead on one end of said cylindrical tubular portion and said "L" shaped slot on said other of said other end of said at least two cylindrical portions is engaged with said bead on said opposite end of said cylindrical tubular portions, an enclosed toothbrush container is formed.

8. The combination toothbrush container and stand of claim 4 wherein each of said at least two coupling members comprise:

a strip of Velcro mounted on the outer diameter of said cylindrical tubular portion.

9. The combination toothbrush container and stand of claim 8 wherein said engaging means further comprises:

at least two strips of Velcro mounted on the outer diameter of each of said at least two cylindrical tubular end portions whereby when said elongated housing is used as a toothbrush stand, one of said at least two strips of Velcro on one of said at least two cylindrical tubular end portions is joined with one strip of Velcro mounted on said cylindrical tubular portion, one of said at least two strips of Velcro on the other of said at least two cylindrical tubular end portions is joined with the other strip of Velcro on said cylindrical tubular portion and the other of said at least two strips of Velcro on one of said at least two cylindrical tubular end portions is joined with the other of said at least two strips of Velcro on the other of said at least two cylindrical tubular end portions, said at least two cylindrical tubular end portions are further joined with said open end of each of said end portion oriented in an upright direction to said cylindrical tubular portion to form a stand for supporting said toothbrush while said toothbrush is in use and to permit drying of the toothbrush in a free air stream after use.

10. The combination toothbrush container and stand of claim 4 wherein each of said at least two coupling members comprises:

a female gib mounted on the outer diameter of said cylindrical tubular portion; and a male rib-like gib mounted on the outer diameter of the cylindrical tubular portion, said male gib further being mounted on said outer diameter in spaced relationship to said female gib mounted on said outer diameter.

11. The combination toothbrush container and stand of claim 10 wherein said engaging means further comprises:

at least two female gibs mounted on the outer diameter of each of said at least two cylindrical tubular end portions; and at least two male rib-like gibs mounted on the outer diameter of each of said at least two cylindrical tubular end portions, said at least two male gibs further being mounted on the outer diameter in spaced relationship to each of said at least two female gibs mounted on said outer diameter so that when said elongated housing is used as a toothbrush stand, one of said at least two female gibs and one of said at least two male gibs on one of said at least two cylindrical tubular end portions are joined with one of said at least two female gibs and one of said at least two male gibs on said cylindrical tubular portion, one of said at least two female gibs and one of said at least two male gibs on the other of said at least two cylindrical tubular end portions is joined with the other of said at least two female gibs and the other of said at least two male gibs on said cylindrical tubular portion and the other of said at least two female gibs and the other of said at least two female gibs and the other of said at least two male gibs on one of said at least two cylindrical tubular end portions is joined with the other of said at least two female gibs and the other of said at least two male gibs on the other of said at least two cylindrical tubular end portions, said at least two cylindrical tubular end portions further being joined with said open end of each of said end portion oriented in an upright direction to said cylindrical tubular portion to form a stand for supporting said toothbrush while said toothbrush is in use and to permit drying of the toothbrush in a free air stream after use.

* * * * *

UNITED STATES PATENT OFFICE

CERTIFICATE OF CORRECTION

Patent No. 4,234,087 Dated November 18, 1980

Inventor(s) Zoltan I. Pandak

It is certified that error appears in the above-identified patent and that said Letters Patent are hereby corrected as shown below:

Column 3, line 46, delete the word "othe" and insert ----other----.

Column 8, line 47, delete the words "and the other of said at".

Column 8, line 48, delete the words "least two female gibs".

Signed and Sealed this

*Twenty-first* Day of *April 1981*

[SEAL]

*Attest:*

RENE D. TEGTMEYER

*Attesting Officer* *Acting Commissioner of Patents and Trademarks*